US009984593B2

(12) United States Patent
Jubro et al.

(10) Patent No.: US 9,984,593 B2
(45) Date of Patent: May 29, 2018

(54) ELECTRONIC SHELF LABEL WITH ATTACHMENT MEANS FOR AN INFORMATION DISPLAY DEVICE AND SUCH INFORMATION DISPLAY DEVICE

(71) Applicants: Jörgen Jubro, Bälinge (SE); Nils Hulth, Uppsala (SE); Fredrik Tjerneld, Uppsala (SE)

(72) Inventors: Jörgen Jubro, Bälinge (SE); Nils Hulth, Uppsala (SE); Fredrik Tjerneld, Uppsala (SE)

(73) Assignee: PRICER AB, Stockholm (SE)

( * ) Notice: Subject to any disclaimer, the term of this patent is extended or adjusted under 35 U.S.C. 154(b) by 0 days. days.

(21) Appl. No.: 14/413,109

(22) PCT Filed: Jul. 1, 2013

(86) PCT No.: PCT/SE2013/050836
§ 371 (c)(1),
(2) Date: Jan. 6, 2015

(87) PCT Pub. No.: WO2014/007737
PCT Pub. Date: Jan. 9, 2014

(65) Prior Publication Data

US 2015/0170550 A1 Jun. 18, 2015

(30) Foreign Application Priority Data

Jul. 6, 2012 (SE) ..... 1250801
Jul. 6, 2012 (SE) ..... 1250802

(51) Int. Cl.
*G09F 3/08* (2006.01)
*G09F 3/02* (2006.01)
(Continued)

(52) U.S. Cl.
CPC ..... *G09F 3/02* (2013.01); *G09F 3/204* (2013.01); *G09F 3/208* (2013.01); *G09F 7/18* (2013.01); *G09F 2007/1856* (2013.01)

(58) Field of Classification Search
USPC ..... 40/662, 653
See application file for complete search history.

(56) References Cited

U.S. PATENT DOCUMENTS 5,448,226 A * 9/1995 Failing, Jr. ..... G06K 17/0022 235/383
7,009,524 B2 * 3/2006 Capurso ..... G06Q 30/06 340/815.4
(Continued)

FOREIGN PATENT DOCUMENTS

EP 0790549 A2 * 8/1997 ..... G06F 3/147
EP 2347681 A1 7/2011
(Continued)

OTHER PUBLICATIONS

International Search Report dated Oct. 22, 2013.
Corresponding European application, application No. 13812806.1, European Office action dated Jun. 19, 2017, 5 pages.

*Primary Examiner* — Joanne Silbermann
(74) *Attorney, Agent, or Firm* — Cooper Legal Group LLC; Ronald Kachmarik

(57) ABSTRACT

An electronic shelf label for displaying information. The electronic shelf label includes: a casing; an information display area; a printed circuit board; fastening structure for fastening the electronic shelf label on a shelf; and a recess extending from the side surface of the casing. The recess includes attaching structure for attaching external information display devices to the electronic shelf label. An information display device for use in combination with the electronic shelf label is further provided.

18 Claims, 5 Drawing Sheets

(51) Int. Cl.
*G09F 3/20* (2006.01)
*G09F 7/18* (2006.01)

(56) References Cited

U.S. PATENT DOCUMENTS

| | | | | |
|---|---|---|---|---|
| 7,076,900 | B2 * | 7/2006 | Faulkner | G09F 3/04 40/645 |
| 8,356,436 | B2 * | 1/2013 | Horikiri | G09F 3/204 40/124.01 |
| 2007/0013479 | A1 | 1/2007 | Goel et al. | |
| 2007/0040025 | A1 | 2/2007 | Goel et al. | |
| 2010/0007579 | A1 | 1/2010 | Minowa | |

FOREIGN PATENT DOCUMENTS

| | | | | |
|---|---|---|---|---|
| JP | 2005040334 | A | 2/2005 | |
| JP | 3139238 | | 2/2008 | |
| JP | 2011197395 | A | 10/2011 | |
| WO | WO 2010052995 | A1 * | 5/2010 | G09F 3/204 |

* cited by examiner

ELECTRONIC SHELF LABEL WITH ATTACHMENT MEANS FOR AN INFORMATION DISPLAY DEVICE AND SUCH INFORMATION DISPLAY DEVICE

FIELD OF THE INVENTION

The present invention relates to electronic shelf label for displaying information, and an information display device for use in combination with the shelf label.

BACKGROUND OF THE INVENTION

In different types of stores, for example supermarkets etc, electronic shelf labels, also named ESLs, are used for displaying information about the different products offered in the store. The information displayed is for example the name and type of product as well as the price for each of the products.

The electronic shelf labels are communicating with a central control unit that makes it possible to frequently update, and change the information displayed on the labels which saves a considerable amount of time for the persons working in the store, especially if the number of different products sold in the store is high. As an example, a supermarket offers between 5000 and 20000 different products.

The electronic shelf labels used in the store are typically of the same type and they are, except for the information displayed on the label, identical and arranged side by side along the shelves or desks in the store.

However, there is frequently a desire to be able to show additional information directed to a specific product. For example an additional red sign if a product is for sale to a reduced price, a sign identifying if a certain product is produced in an environmentally friendly way or special offers to loyal customers etc.

Today, these signs/flags are made of a sheet of paper or plastic material that is inserted in slots arranged around the outside periphery of the shelf label casing to be fastened, alternatively arranged on sparate devices along the shelves. However, the signs/flags are easily unintentionally removed, alternatively they fall out of the slots and are lost, or left at the shelf even though the ESLs are removed.

There is consequently a need for an improved electronic shelf label that makes it possible to add external signs/flags to display additional information together with the ESL.

SUMMARY OF THE INVENTION

The present invention, defined in the appended claims, provides an electronic shelf label, and an information display device that fulfils the needs defined above.

The claimed electronic shelf label for displaying information comprises: a casing comprising at least one side surface, a front side and a back side; an information display area arranged in the front side; a printed circuit board; fastening means for fastening the electronic shelf label on a shelf; and a recess extending from the side surface of the casing, wherein the recess comprises attaching means for attaching external information display devices to the electronic shelf label.

The claimed arrangement fulfils the needs defined above since the electronic shelf label is provided with an arrangement that makes it possible to attach different information display devices in a reliable way to the label casing. The attachment means ensures a resistant fastening of the external display devices.

Furthermore, the attachment means makes it possible to attach different types of information display devices that provide additional information or decoration to the electronic shelf label using the same attachment means.

A further advantage with the claimed invention is that the additional information display device is directly connected to the electric shelf label which ensures that the information display device is removed from the shelf together with the shelf label during reorganisations in the store.

In one embodiment of the electronic shelf, the casing comprises a first side surface, a second side surface, an upper side and a lower side, and said recess is extending from one of the side surfaces and is formed in the back side of the electronic shelf label. This embodiment is favourable since the attachment means are easily accesible even though the shelf label are arranged along the forward edge of a shelf or at a desk in the store.

In one embodiment of the electronic shelf, the recess has an upper and a lower groove extending substantially parallel to each other and substantially transverse from one of the side surfaces of the casing, said upper and lower groove acts as guides for the external information display device inserted in the recess and secured to the shelf label. This design of the recess makes it easy to insert and attach the information display device to the shelf label. Furthermore, the desired support for the information display device is achieved which is essential to achieve the stable and reliable attachment of the information display device.

In one embodiment of the electronic shelf label, the attaching means, arranged in the recess, comprises at least one locking surface that is intended for maintaining the external information display device in the recess. The locking surface further improves the reliability of the securing of the information display device.

One embodiment of the electronic shelf label, comprises detecting means for detecting if an external information display device is attached to the shelf label, said detecting means are arranged in said recess and communicating with the printed circuit board. The detecting means makes it possible to adapt the information displayed on the electronic shelf label depending when an external information display device is attached to the shelf label. The detecting means could furthermore be configured to detect which type of information display device that is attached to the ESL.

In one embodiment of the electronic shelf label, the electronic shelf label comprises connecting means arranged within the recess, said connecting means are communicating with the printed circuit board in order to make it possible to attach information display devices comprising illumination or displays.

The invention furthermore relates to an information display device comprising: a device body; configured to fit in the recess of the electronic shelf label; and a releasable locking mechanism arranged on said device body. The locking mechanism is cooperating with the attachment means of the shelf label.

The information display device is intended for use in combination with an electronic shelf label as defined above to fulfill the defined need regarding the possibility to display additional talkers, flags, signs, coupons, displays etc together with the electronic display device.

In one embodiment of the display device, the releasable locking mechanism comprises a protrusion extending from the device body and at least one attachment surface, said attachment surface is extending from said protrusion, said protrusion and attachment surface are resiliently supported in relation to the device body and strives to attain a locking position in which the attachment surface is in contact with the at least one locking surface of the electronic shelf label surface according to the embodiment described above.

In one embodiment of the display device, the locking mechanism is releasable by a control device extending from the device body to be accessible from the exterior of the shelf label when the information display device is attached to the electronic shelf label arranged along the forward edge of a shelf.

In one embodiment of the display device, the information display surface is secured in the device body by fastening means arranged on the device body, said fastening means are configured to hold the sign, flag, marking, frame, or additional electronic display. This is a practical embodiment since the device body is adapted to fit in the recess and provide the desired attachment to the shelf label. The selected type of display surfaces is secured to the device body that could be reused.

In one embodiment of the display device, the information display surface is arranged on a sheet of a plastic or paper material. These materials are cheap, easy to manufacture, and could be printed in any desired colour or pattern.

In one embodiment of the display device, the information display surface is shaped like a frame surrounding the front side of the electronic shelf label. The frame-like display surface could for example be arranged to provide desired colour to ESLs displaying information directed to ecologically produced products etc. Alternatively used for providing the ESLs with a specific pattern, shape and/or colour directed to a specific store or brand.

The different described embodiments of the arrangement could of course be combined in different ways without departing from the scope of the invention that will be described more in detail in the detailed description.

BRIEF DESCRIPTION OF THE DRAWINGS

One embodiment of the ESL and the information display devices according to the invention are illustrated in the appended figures.

DETAILED DESCRIPTION OF EMBODIMENTS

Figure 1:
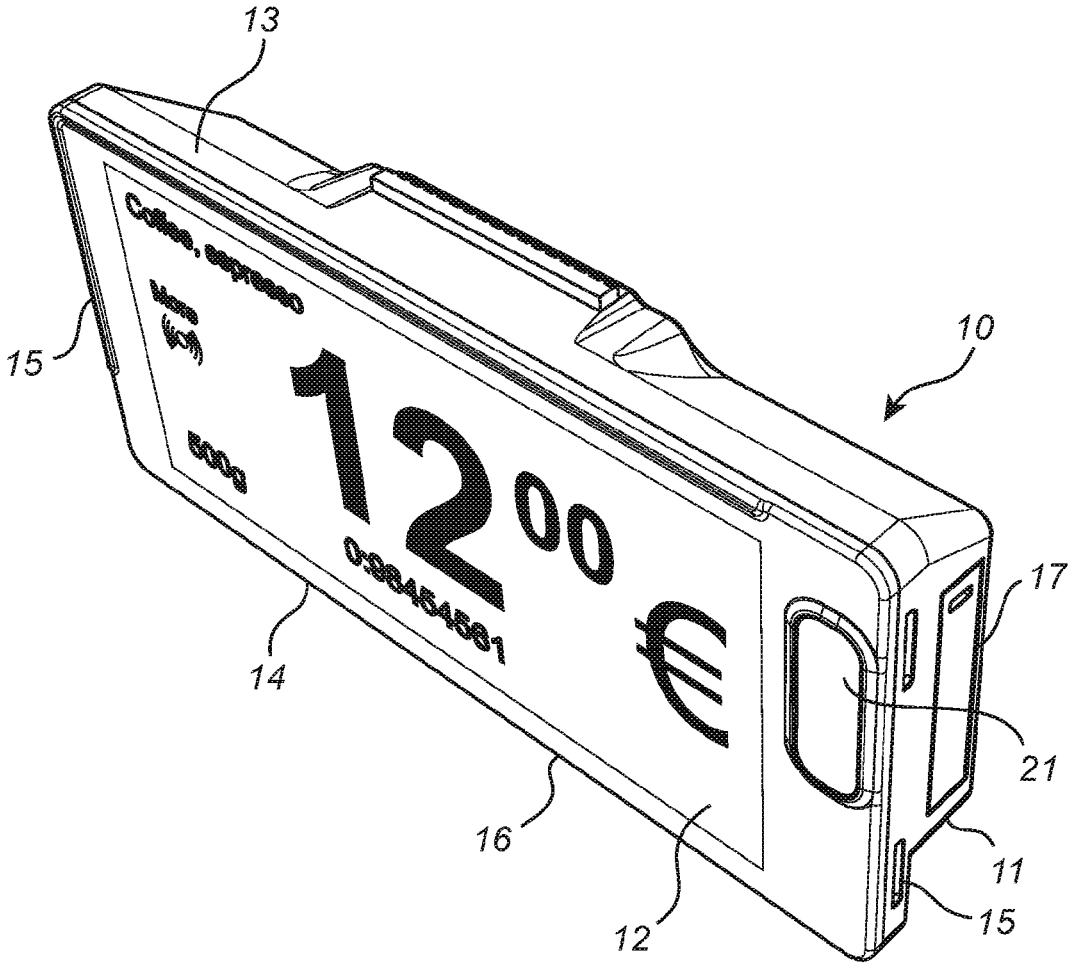
FIG. 1 illustrates a perspective view of an ELS.
Figure 2:
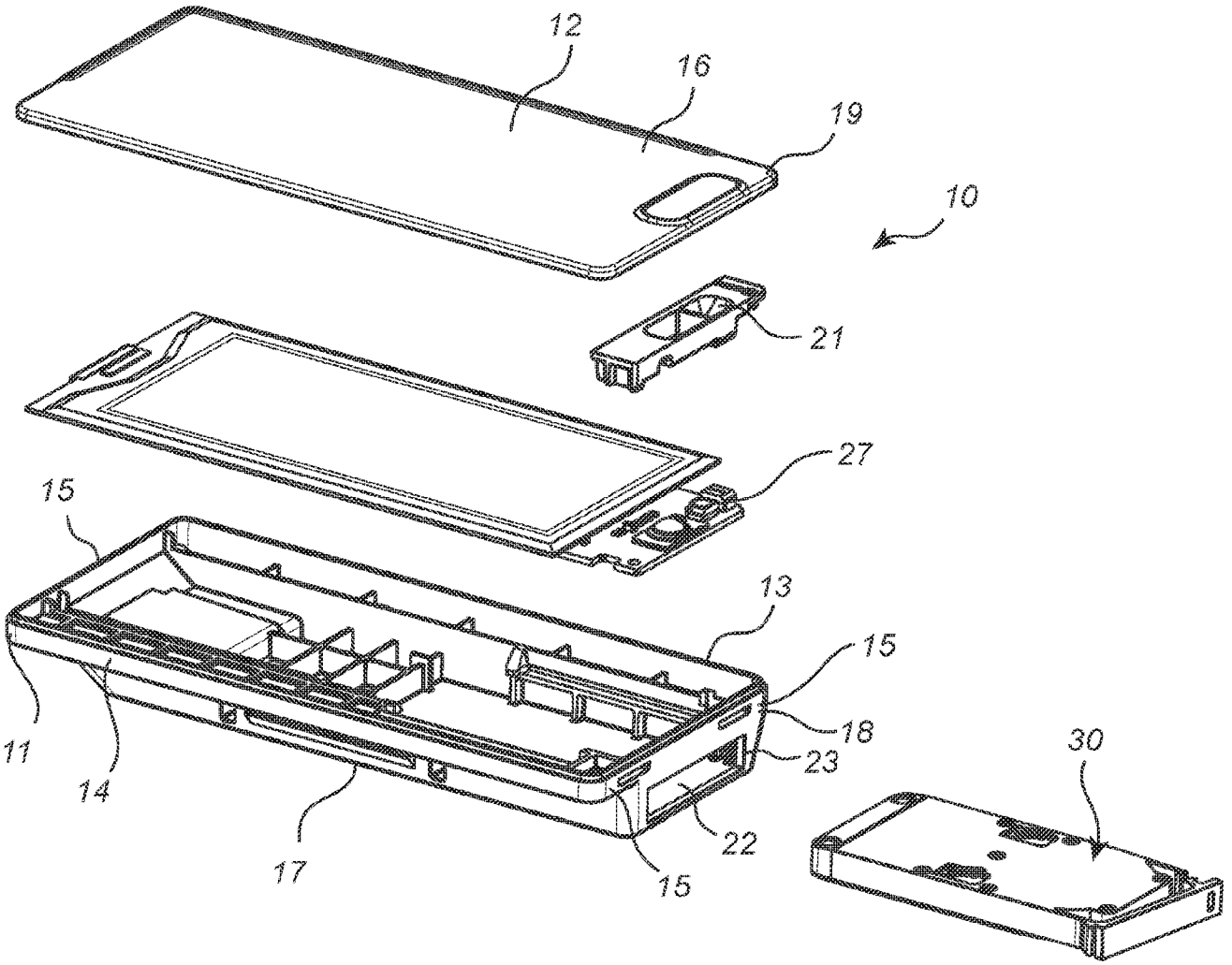
FIG. 2 illustrates an exploded view of the ESL.

In FIG. 1 a perspective view of an ESL, and in FIG. 2 an exploded view of an electronic shelf label 10, ESL, is illustrated. The ESL 10 comprises a housing or casing 11 and a display area 12. The housing is substantially rectangular with an upper 13 and lower side 14 arranged parallel to each other, two side surfaces 15, and a front 16 and back 17 side. The front side is substantially flat and comprises the display area 12. The housing 11 is made of at least a first 18 and a second 19 housing section in order to facilitate the manufacturing of the different sections and the mounting of the different components enclosed by the housing 11. The housing is for example made of a plastic material that provides the desired structural strength as well as the desired appearance of the ESL. The display area 12 is preferably as large as possible to improve the visibility of the ESL during use. The layout on the display is adapted to the specific use of the ESL.

Along the upper and lower side of the ESL, elongated protrusions 20 are extending. The elongated protrusions are example means that make it possible to fasten the ESL in a fastening rail arranged along the forward edge of a shelf or desk. The fastening rail, not illustrated in the figures, has a C-shaped cross section and encloses the back side of the ESL when the ESL is fastened in the intended position along the fastening rail. However, other solutions for fastening the ESL to a shelf are already known and could of course be used instead of the described solution.

In the front side of the ESL, means 21 for communication between the ESL, specifically a printed circuit board 27 thereof, and a central control system is arranged. In the illustrated ESL, this communication involves means for infra red optical communication with an in the store centrally arranged control unit. Other alternatives for communication between the ESL and the central control system are however possible and the means for communication arranged in the ESL are then modified or adapted to the desired system for communication. In a further embodiment of an ESL, the means for communication could be arranged in the side surfaces or integrated within the casing as long as the desired contact between the ESL and the central control unit is achieved.

The ESL furthermore comprises a battery cassette 30 arranged in a cavity 22 in one of the side surfaces of the casing. The cavity is arranged within the housing 11 and extends from a first opening 23 in one of the side surfaces of the housing into the ESL. The size and shape of the cavity 22 corresponds to the size and shape of the battery cassette 30.

The battery cassette 30 comprises at least one battery for powering the ESL. The number and size of the battery, or batteries, could however be changed to adapt the ESL to specific needs. The battery cassette furthermore comprises a first and a second contacting element for connecting the two poles of the battery, or batteries, with the ESL. Within the recess, contacts for connecting the battery in the battery cassette with the components of the ESL requiring power to work as intended are arranged. The contacts could be arranged anywhere in the recess as long as the position of the contacts correspond the contact elements of the battery cassette.

Figure 3:
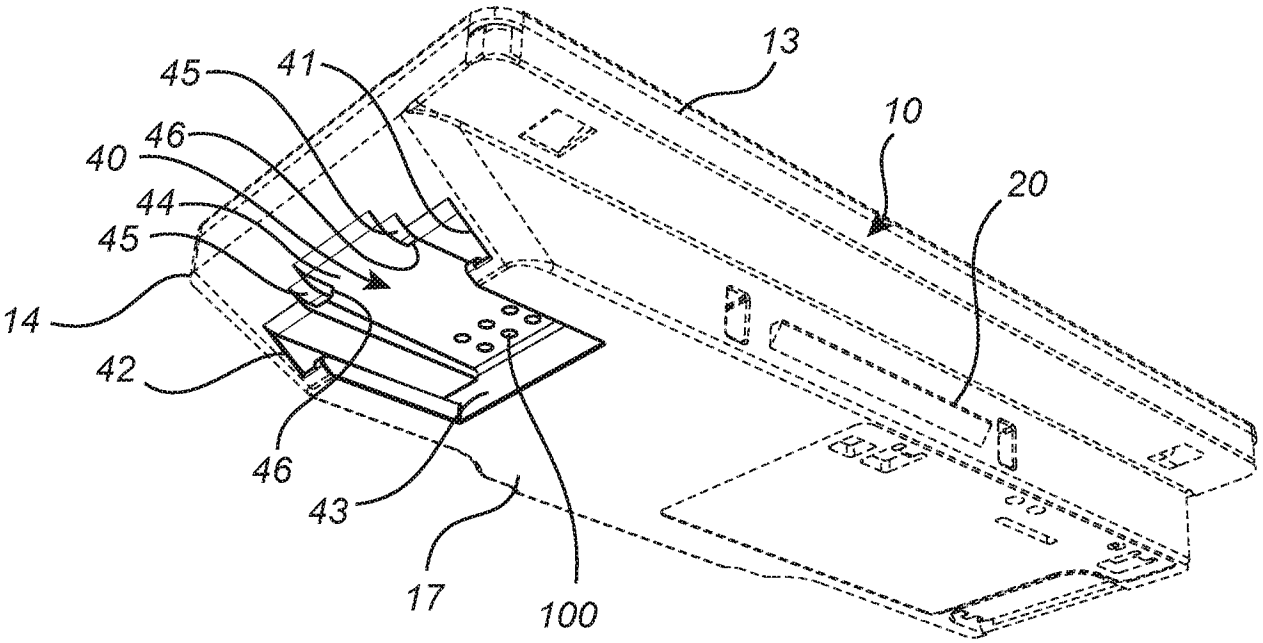
FIG. 3 illustrates a back side of the ESL in perspective

In FIG. 3, a perspective view of the back side of the ESL is illustrated. In the back side, a recess 40 extending from one of the side surfaces is formed in the back side 17 of the casing 11. The ESL casing is illustrated with broken lines to more clearly illustrate the recess 40 that is drawn with continuous lines. The recess is intended for securing additional display devices such as for example shelf flags, illustrated in FIG. 4, extending substantially transverse to the front surface of the ESL, shelf talkers, illustrated in FIG. 5, that extend substantially parallel to the front surface of the ESL, or other types of additional display devices. The different alternatives and their respective attachment to the ESL will be described in detail with reference to the figures.

The recess size and dimensions are selected to provide sufficient support for the different information display devices that might be attached to the ESL 10 via the recess 40. This is achieved by the recess 40 illustrated in FIG. 3. The recess has an upper 41 and lower 42 groove extending substantially parallel to the upper and lower sides of the ESL from the side surface of the ESL. The upper and lower grooves are in the illustrated embodiment substantially parallel to each other and extending substantially transverse from the side surface into the back side of the housing. The width of the grooves is substantially constant along the grooves and the grooves provide support and guidance of the information display device during the attachment to the ESL.

The recess is ended by a substantially flat vertically arranged inner wall 43 formed in the back side of the ESL as well. The recess furthermore comprises a central section 44 defined between the upper and lower groove. In the illustrated embodiment, the central section extend further into the ESL housing towards the front compared to the grooves. The central section 44 is substantially flat and slightly angled compared to the grooves so that the depth of the recess is increasing from the inner wall towards the side surface of the ESL. The central section is extending all the way to the side surface of the ESL except for a flange 45 arranged adjacent to each of the upper and lower groove along the side surface of the ESL. On the side of the flange that is facing the inner wall of the recess, a stop surface 46 is arranged on each of the flanges. The stop surfaces 46 are substantially flat and extend in a substantially vertical direction parallel to the side surface of the ESL. The height of the flange, and the stop surface, is selected so that a passage is formed between the upper edge of the flange and the back side 17 of the ESL in order to make it possible to insert the information display device in the recess. In the illustrated embodiment, the flange is extending from the central section almost up to the edge of the grooves in the side surface. The stop surfaces are used for securing the different information display devices attached to the ESL in the desired position and prevent that the attached devices are unintentionally released from the ESL. The design of the grooves, the central section, the flange and the stop surface could however be modified in many different ways as long as the function of the different parts are ensured. For example, in the illustrated embodiment the recess is open towards the back surface of the ESL but could also be shaped like a recess extending into the housing from an opening in the side surface of the ESL, and one of the stop surfaces could be eliminated as long as the securing of the information display device achieved.

Figure 4:
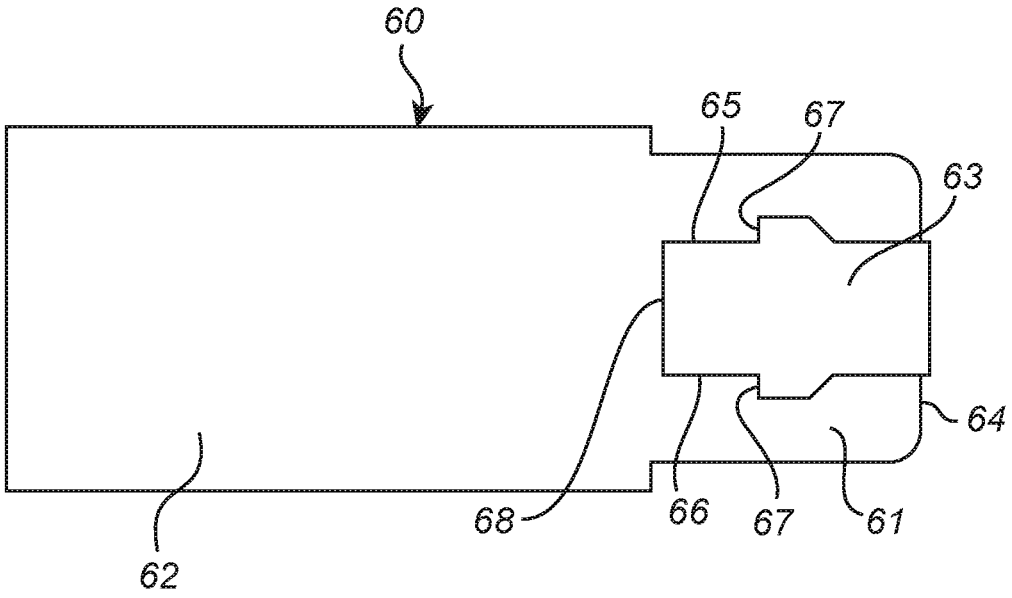
FIG. 4 illustrates a first embodiment of an information display device in perspective.

In FIG. 4, a front view of an information display device 60 according to a first embodiment, i.e. a shelf talker, is illustrated. The illustrated shelf talker is intended to be fitted to an ESL according to anyone of the embodiments described above.

The information display device is formed of a sheet of paper or plastic material and comprises a substantially rectangular device body 61, an information display surface 62 and a protrusion 63 extending from the device body 61.

The information display surface 62 is in the disclosed embodiment of the shelf talker a rectangular flat surface that is intended to be arranged adjacent to the ESL when the information display device is attached to the ESL. The size and shape could however be modified in a number of different ways. For example the design of the information display surface could be square, triangular, or any other suitable shape for displaying the desired information.

The device body 61 is configured to fit in the recess of the ESL and has a height that corresponds to the distance between the upper 41 and lower 42 groove in the ESL. Furthermore, the device body has a length that is at least equal to the distance between the side surface of the ESL and the vertical end wall 43 of the recess in the ESL in order to make it possible to insert the device body all the way to the end wall for best possible support of the information display device in the recess.

In the illustrated embodiment, the protrusion 63 extends from the side 64 of the device body that will be arranged adjacent to the vertical end wall. The protrusion has a substantially rectangular shape with a smaller width than the device body. The width of the protrusion 63 is selected to correspond to the dimensions of the central section 44 of the recess in the ESL and the width of the protrusion is smaller than the height of the central section so that, after the protrusion has been folded along the side 64 of the device body 63 arranged adjacent to the vertical end wall 43, the protrusion 63 will fit within the central section 44 of the recess.

From the upper 65 and lower side 66 of the protrusion 63, attachment surfaces 67 extend substantially transverse. The position of the attachment surfaces 67 along the upper and lower side of the protrusion is selected to correspond to the position of the stop surfaces 46 on the flanges of the recess 40 in the ESL 10. The overall width between the outer ends of the attachment surfaces 67 arranged on opposite sides of the protrusion is equal to, or less than the height of the central section 44 of the recess 40.

When the shelf talker 60 is attached to the ESL, the device body 61 is inserted in the recess 40 all the way to the vertical end wall 43 within the recess. When the device body 61 is correctly positioned within the recess 40, the attachment surfaces 67 of the information display device 60 will be in contact with the stop surfaces 46 of the recess which means that the display device 60 is attached to the ESL 10 and prevented from falling off by the locking surface 46. The fact that the information display device is made of a sheet of paper or plastic material result in that the protrusion, after the folding, is resiliently supported to the device body 61 and strives to return to the unfolded position, i.e. strive to attain the locking position in which the stop surfaces 46 of the ESL is in contact with the e attaching surfaces 67 of the display device 60.

To release the information display device, the outer end 68 of the protrusion, arranged outside the recess 40, that is acting as a control device for the locking mechanism is pressed towards the device body such that the attachment surfaces 67 and the locking surfaces 46 are released from each other and the display device 60 could be removed from the ESL 10.

Figure 5:
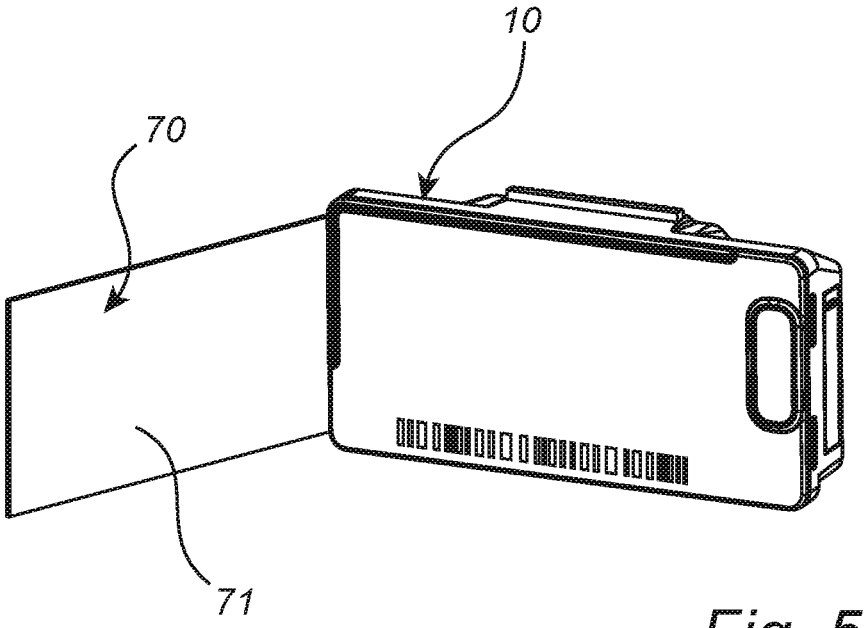
FIG. 5 illustrates a second embodiment of an information display device in perspective.

In FIG. 5, an information display device 70 in the form of a shelf flag attached to an ESL 10 is illustrated. The illustrated shelf flag is, as the shelf talker 60 described above, made of a sheet of paper or a plastic material. The shelf flag have many features in common with the shelf talker described above and the shape and size of the device body and the protrusion for locking the shelf flag to the ESL is identical to the shelf flag described above. However, the display surface 72 of the shelf flag 70 is arranged substantially perpendicular to the device body 71 so that the shelf flag is extending forward of the ESL display area to be more easily detected by a customer or visitor in a store. This is achieved by an additional fold arranged between the device body 71 and the display surface 72.

Since the locking mechanism of the shelf flag 70 is identical to the one described above, the locking mechanism is released in the same way, i.e. by pressing the protrusion 63 towards the device body 71 to disengage the attachment surfaces 67 of the information display device from the stop surfaces 46 of the recess 40. Due to the additional fold that makes the shelf flag extend perpendicular to the device body, the disengaging of the display device 70 is complicated and in a favourable embodiment of the shelf flag the length of the protrusion 63 is increased to exceed the length of the device body 61. Furthermore an opening is arranged in the area of the fold between the device body and the information display surface 71. The width of the opening is exceeding the width of the protrusion so that the protrusion could be lead through the opening in order to be reachable from the area outside of the information display surface 71. This embodiment facilitates the disengaging of the shelf flag considerably.

Figure 6A:
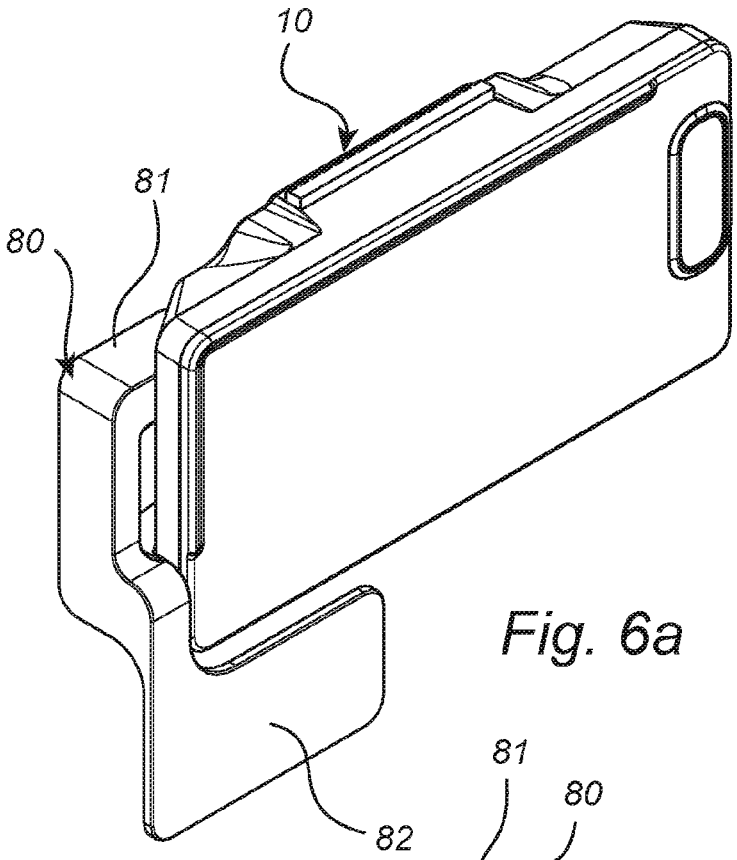
FIG. 6*a* illustrates a third embodiment of an information display device attached to an ESL in perspective.
Figure 6B:
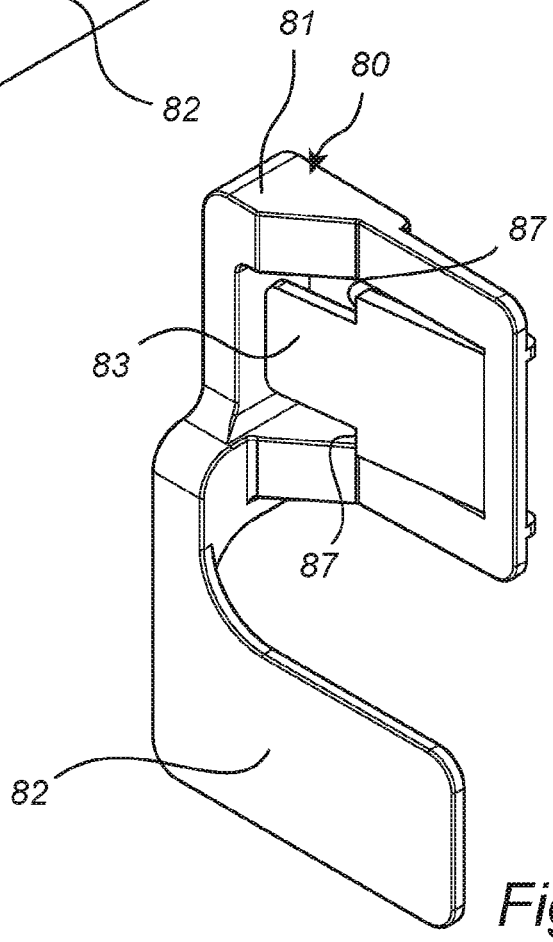
FIG. 6*b* illustrates the third embodiment of the information display device in perspective

A further embodiment of the information display device 80, illustrated in FIG. 6*a* attached to an ESL and alone in FIG. 6*b*, comprises an information display surface 82 extending from a a device body. In an alternative embodiment, not illustrated, the information display surface could be a separate display surface attached to the device body by fastening means arranged on the device body. The device body 81 is made of a plastic material casted in a mould to the desired shape. The device body 81 is intended to be fitted in the same recess 40 as the previously described shelf talker 60 and shelf flag 70 and comprises a releasable locking mechanism arranged on the device body. The locking mechanism has the same configuration as the one described above, i.e. comprises a protrusion 83 and an attachment surface 87 intended to cooperate with the stop surface 46 of the recess 40 in the shelf label. The fact that the device body 81 is casted requires that the device body 81 is casted with the protrusion 83 extending from the side of the device body that will be arranged adjacent to the vertical end wall 43 of the recess in the ESL. The protrusion has the same shape and width as the recess in the ESL and is directed in the desired direction. The attachment edges 87 extend substantially transverse from the upper and lower edge of the device body 83 and the position of the protrusions are selected to correspond to the position of the stop surfaces on the flanges of the recess in the ESL. This embodiment is favorable since the device body 81 could be reused a number of times.

If the device body is provided with fastening means, different types of signs, flags, markings, frames, or additional electronic display could be secured in a reliable way. There are a number of fastening means or fastening arrangements that could be fitted on the device body. One example is one or more slots in which the information display surface is inserted arranged along the side of the device body facing away from the recess, alternatively an hook or knob onto which tags or coupons are arranged.

A further improved ESL comprises a detector for recognising if an information display device is attached to the ESL via the recess. The detector is arranged somewhere in, or close to, the recess and connected to the control unit arranged on the printed circuit board in order to make it possible to adapt the information displayed on the ESL to the attached information display device when an information display device is attached to the ESL. The detector could be any known detector type suitable for detecting the presence of the device body in the recess.

Furthermore, the ESL could comprise connecting means 100 for an external accessory such as a display or illumination device. The connecting means for the external display or illumination device is arranged in the ESL housing 11 easily accessible, for example in one of the side surfaces of the housing or preferably arranged in the recess 40 for attaching additional information display devices. The connecting means in the housing are connected with the control unit in the ESL and makes it possible to combine the ESL with an external display or illumination device attached to the ESL via the recess in the housing. The external accessory comprises a device body and a locking mechanism arranged on said device body as already described above for securing the external accessory to the ESL, alternatively the display or illumination device are attached to the separately arranged and described device body.

Examples of external accessories that could be connected to the ESL are: one, or more, additional displays, illumination devices, sensors, NFC-labels, RFID-labels or additional memory capacity.

The additional display, or displays, makes it possible to increase the amount of information communicated from the ESL and/or increase the size of letters, numbers or symbols on the display to facilitate for the reader. The additional display is preferably arranged adjacent to the ESL display, i.e. arranged in line with the ESL display alternatively above or beneath the ESL display. One type of external display that could be connected to the ESL is an eye catching display with a few segments forming a pattern. One example of this type of display is an E-paper display like E-ink displays or similar.

Illumination devices, such as coloured lamps and/or LEDs could be used in order to illuminate the ESL or the product that the ESL is promoting, alternatively twinkling lights to draw the attention from a possible customer to a specific shelf or product that is new or at the moment offered to a reduced price etc.

Additional memory capacity in order to upgrade ESLs suffering from limited memory capacity could be very favourable since a complete replacement of the entire ESL is avoided. The additional memory could be arranged in a memory stick such as for example a USB-memory or similar arrangement that is easy to attach to the ESL.

Sensors could be arranged together with the ESL in order to make it possible to detect the amount of items remaining of the product on the shelf that the ELS is displaying information about. The sensor is communication with the printed circuit board in order to make is possible to display selected information on the ESL depending on the detected information regarding the items on the shelf detected by the sensor. For example, information directing the customer to another shelf with similar produces could be displayed; alternatively a coloured and/or twinkling light to make the staff aware of that refill of items is required.

The connecting means of the ESL are connected to the printed circuit board, and the components arranged on the printed circuit board. This means that information could be sent from the external accessory to the ESL as well as in the opposite direction. When an external accessory is connected to the ESL, the information displayed on the ESL could be adapted to correspond to, or complement the information displayed on the added display.

In a further favourable embodiment of the ESL, the connecting means are arranged within the recess 22 for the battery cassette 30. In order to attach the external accessory, the battery cassette is removed and the connecting means exposed within the recess. This embodiment is very favourable since the recess for the battery cassette in the ESL housing could be used as guide and support for the attached external accessory which makes it possible to achieve a rigid and stable attachment of the external accessory. However, since the battery cassette must be removed to expose the connecting means, the attached external accessory must comprise at least one battery for powering both the external accessory and the ESL.

In order to make it possible to attach the external accessory to the ESL, the accessory must comprise an accessory body with a cross-sectional shape and length corresponding to the shape and length of the recess that the external accessory is intended to be fitted in. Furthermore, the accessory body is provided with connecting devices corresponding to the connecting means of the ESL for connecting the external accessory to the connecting means of the ESL. In order to attach the external accessory to the ESL, the accessory body in inserted into the recess and the connecting device of the accessory bought into contact with the connecting means of the ESL.

Different types of displays, illumination devices, different types of sensors, NFC-labels, RFID-labels or external memories could be arranged together with the device body and connected to the ESL via the connecting means in the recess 40.

A favourable embodiment of the ESL comprises securing means arranged together with the connecting means. The securing means maintains the connecting device of an external accessory in the desired position in contact with the connecting means arranged in the ESL housing.

The connecting means of the ESL, as well as the connecting devices of the external accessories, are preferably connectors of standard type in order to reduce the overall costs for the ESL, and ensure that spare parts are easily available in case of damages to different components.

The different embodiments described above could all be combined and modified in different ways without departing from the scope of the invention that is defined by the appended claims.

The invention claimed is:

1. Electronic shelf label for displaying information, said electronic shelf label comprising:

a casing comprising at least one side surface, a front side and a back side;

an information display area arranged in the front side;

a printed circuit board;

fastening means for fastening the electronic shelf label on a shelf;

a recess; and an external information display device;

wherein the recess extending from the side surface of the casing for receiving the external information display device, wherein the recess comprises attaching means for attaching the external information display device to the electronic shelf label; and wherein the external information display device extending at least partially within the recess and partially along a plane within the recess, the external information display device having a protrusion extending in a transverse direction out from the plane within the recess, with the protrusion having a transversely extending attachment surface that is transverse to the plane within the recess and transverse to the direction of extent of the protrusion, the attaching means, being arranged in the recess, comprises at least one locking surface located and configured to contact against the transversely extending attachment surface of the protrusion of the external information display device to block movement of the external information display device and maintain the external information display device in the recess.

2. The electronic shelf label as defined in claim 1, wherein the casing comprises a first side surface, a second side surface, an upper side and a lower side, and said recess is extending from one of the side surfaces and is formed in the back side of the electronic shelf label.

3. The electronic shelf label as defined in claim 2, wherein the recess has an upper and a lower groove extending substantially parallel to each other and substantially transverse from one of the side surfaces of the casing, said upper and lower groove acts as guides for the external information display device inserted in the recess and secured to the shelf label.

4. The electronic shelf label as defined in claim 1, wherein the electronic shelf label comprises connecting means arranged within the recess, said connecting means are communicating with the printed circuit board.

5. The electronic shelf label as defined in claim 1, wherein the information display device comprising:

a information display surface; and a device body configured to fit in the recess.

6. The electronic shelf label as defined in claim 5, comprising a control device extending from the device body to be accessible from the exterior of the electronic shelf label when the information display device is attached to the electronic shelf label and actuatable to release the information display device.

7. The electronic shelf label as defined in claim 5, wherein said fastening means are configured to hold a sign, flag, marking, frame, hook or additional electronic display.

8. The electronic shelf label as defined in claim 5, wherein the information display surface is arranged on a sheet of a plastic or paper material.

9. The electronic shelf label as defined in claim 5, wherein the device body extends in a plane, the protrusion extends transversely from the plane of the device body, and the attachment surface extends transversely to the plane of the device body and extends transversely to the extent of the protrusion from the plane of the device body.

10. The electronic shelf label as defined in claim 5, wherein the information display surface extends parallel to the plane of the device body.

11. The electronic shelf label as defined in claim 10, wherein the information display surface is coplanar with the plane of the device body.

12. The electronic shelf label as defined in claim 10, wherein the information display surface is off-set from the plane of the device body.

13. The electronic shelf label as defined in claim 5, wherein the information display surface extends transverse to the plane of the device body.

14. The electronic shelf label as defined in claim 5, wherein the protrusion comprises two attachment surfaces, and each attachment surface is located at an opposite side of the protrusion.

15. The electronic shelf label as defined in claim 14, wherein the device body extends in a plane, and the two attachment surfaces are both located offset from the plane within which the device body extends and on a same side of the plane within which the device body extends.

16. The electronic shelf label as defined in claim 5, wherein the information display device is made of paper.

17. The electronic shelf label as defined in claim 5, wherein the information display device is made of casted plastic.

18. The electronic shelf label as defined in claim 17, wherein the protrusion is a deformable plastic tab of the casted plastic the information display device.

* * * * *